United States Patent [19]

Belfils

[11] 4,133,261

[45] Jan. 9, 1979

[54] CAN CRUSHER

[76] Inventor: Larry M. Belfils, 12670 San Pablo Ave., Richmond, Calif. 94803

[21] Appl. No.: 810,526

[22] Filed: Jun. 27, 1977

[51] Int. Cl.[2] ..... B30B 1/04

[52] U.S. Cl. ..... 100/280; 100/DIG. 2; 100/295

[58] Field of Search ..... 100/DIG. 2, 293, 295, 100/283, 231, 280, 116; 241/99; 29/251; 83/570; 99/581

[56] References Cited

U.S. PATENT DOCUMENTS

| | | | |
|---|---|---|---|
| 492,259 | 2/1893 | Barrett | 100/280 |
| 684,784 | 10/1901 | De Bolster | 100/116 |
| 1,350,477 | 8/1920 | Small | 100/293 |
| 2,563,379 | 8/1951 | Smith | 100/DIG. 2 |
| 3,208,372 | 9/1965 | Taylor | 100/DIG. 2 |
| 3,780,647 | 12/1973 | Reimers | 100/DIG. 2 |
| 3,889,587 | 6/1975 | Wharton | 100/DIG. 2 |

FOREIGN PATENT DOCUMENTS

| | | | |
|---|---|---|---|
| 1156139 | 6/1969 | United Kingdom | 100/DIG. 2 |

*Primary Examiner*—Billy J. Wilhite
*Attorney, Agent, or Firm*—Henry G. Kohlmann

[57] ABSTRACT

This invention relates generally to devices designed to crush metal cans such as beverage containers and the like. More specifically, this invention relates to a can crushing device having a base upon which to place the can to be crushed and having a means for criming one side of said can when pressure is applied to the top of said can by a pressure exerting means connected to said base. Said device further has means for allowing air to escape from said can when the same is being crushed.

3 Claims, 5 Drawing Figures

CAN CRUSHER

BACKGROUND OF THE INVENTION

1. Field of the Invention

This invention relates generally to can crushing devices. More specifically, this invention relates to hand operated devices designed to crush cans, such as beverage cans and the like in a vertical direction thus reducing their volume and allowing the sale or presentation of the same to various metal reclaiming stations for recycle of our natural resources.

2. Description of the Prior Art

Many can crushing devices have been devised over the history of the prior art. Most of the original hand operated devices crushed beverage cans and the like from the side as is typified by U.S. Pat. No. 3,777,659 by Mc Carten. Side crushing was required in hand operated devices because less pressure was required to cause the can to collapse. The stronger top and bottom of said cans would merely fold in half but would create more bulk at the ends of said can. The air inside such cans was released without restruction through the standard opening in the can minimizing any necessity for greater pressure to compress the air. The result however, is a crushed can often having exposed sharp edges due to the fracture of the top of the can when folded as illustrated in FIG. 6 of Mc Carten. In addition to them being dangerous to handle, such crushed cans do not stack well because the ends are not compacted to the same volume as the center of said cans. Thus, the storage volume is governed solely by the thickness of the ends of the cans and much wasted space results when such cans are stored.

However, when vertical crushing is attempted — so as to provide a more compact end result, i.e., less wasted volume — the device for crushing said can itself traps air inside thus requiring an extreme amount of pressure to compress the same. Further, the can structure in the vertical direction is extremely strong and requires great pressure to compress the same.

Such vertical compression devices are typified by U.S. Pat. No. 3,889,587 by Wharton. Due to the great pressure required, such devices are quite bulky and complicated in design. The Wharton device for example slits the can then contains the can within a cylindrical structure so that when the same is crushed the dangerous sharp edges created thereby are minimized by being folded inward somewhat.

It is the object of the present invention to provide a can crushing device which crushes the can in such a manner so as to eliminate exposed sharp edges.

It is a further object of this invention to provide a hand operated can crushing device which requires minimal pressure and can be safely operated by children.

It is a further object of this invention to provide a means for crushing cans which allows the air contained therein to escape without slitting or puncturing the can.

It is a final object of this invention to provide a structurally lightweight, economical, uncomplicated can crushing apparatus.

DESCRIPTION OF THE PREFERRED EMBODIMENT

Figure 1:
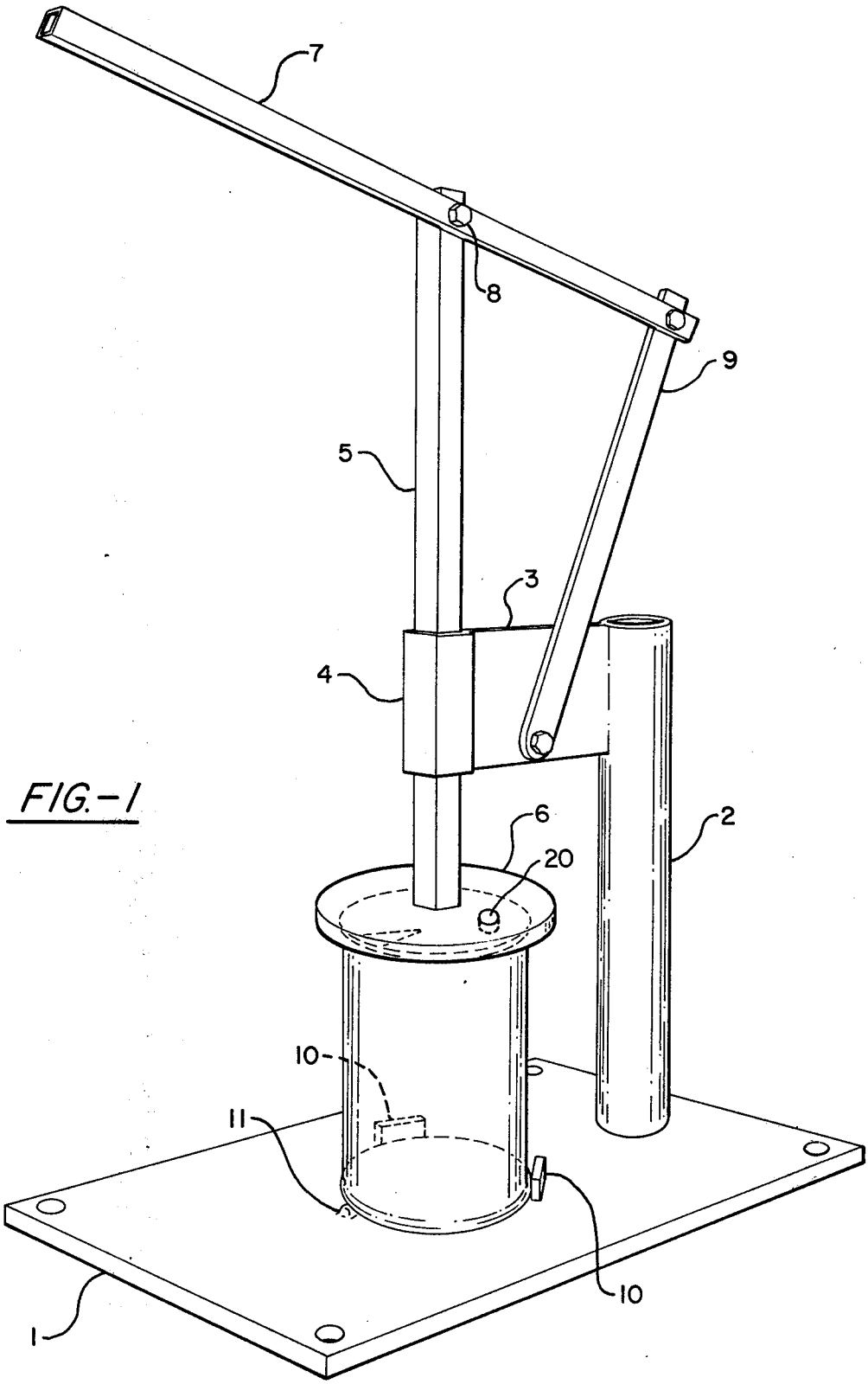
FIG. 1 is a perspective view of the can crushing apparatus.

With reference to the drawings, FIG. 1 shows the can crushing apparatus having a base 1. Attached to and supported by the base is a vertically disposed upright 2 A mounting plate 3 is attached at one end to the top of said upright 2 and extends outwardly over the base 1. Said mounting plate 3 is attached at the opposite end to a tubular member 4 such that the longitudinal axis of said member 4 is perpendicular to the base. Member 4 is adapted for slidably receiving elongated member 5. At the end of member 5 nearest the base is a contact plate 6. Said contact plate 6 having a flat lower surface and a hole 20 extending through said plate 6 from the lower to the upper surface. Said hole being so positioned that air trapped in a can to be crushed may escape therefrom. The opposite end of member 5 is rotatably attached to a handle 7 at a point remote from one end by a nut and bolt structure 8. Said handle 7 is rotatably connected at the other end to a rotating bar 9. Said rotating bar 9 is attached at the end opposite said handle 7 to mounting plate 3. Thus, when one end of said handle 7 is raised the axis of rotation about the other end of said handle moves toward said elongated member 5 allowing a full range of motion from a raised position to a lowered position in a smaller structure than otherwise possible.

Attached to the base 1 and underneath said contact plate 6 are two position ridges 10 and one crimping bead 11. Said ridges 10 are angularly disposed of one another and provide a position indicator for the user. When it is desired to crush a can, the user places the can on the base and slides it against the ridges 10 which hold said can in place. Crimping bead 11 in so positioned that when a can of a diameter sufficient to engage said crimping bead is placed against said ridges 10 said crimping bead protrudes from underneath the edge of said can and causes one side thereof to be slightly raised. For illustration purposes, said bead is shown as relatively short, however, it may be made as long as desired. It is, however, important that the crimping bead 11 be directly under at least one edge of the can to be crushed. Additional crimping beads may be provided if desired but the apparatus operates at an optimum with only one such bead.

Figure 2:
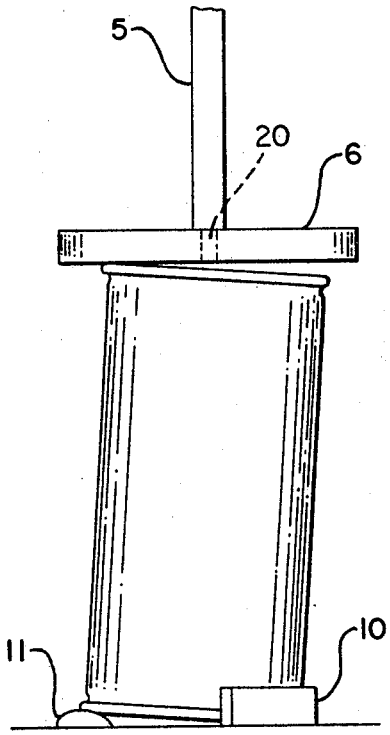
FIG. 2 if a side view of a can in position to be crushed and the relevant portion of the apparatus.
Figure 3:
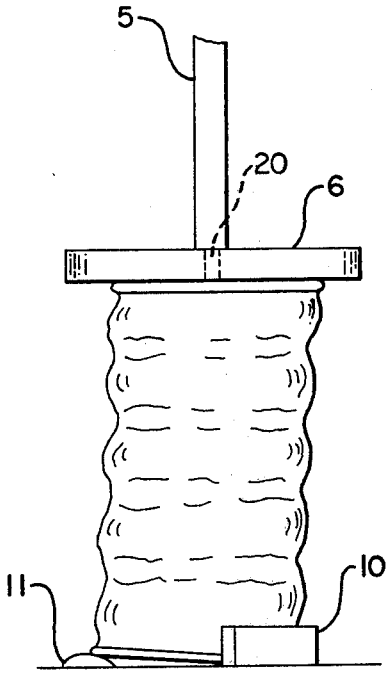
FIG. 3 is a side view of a can and a portion of the apparatus at the initiation of the crushing operation.
Figure 4:
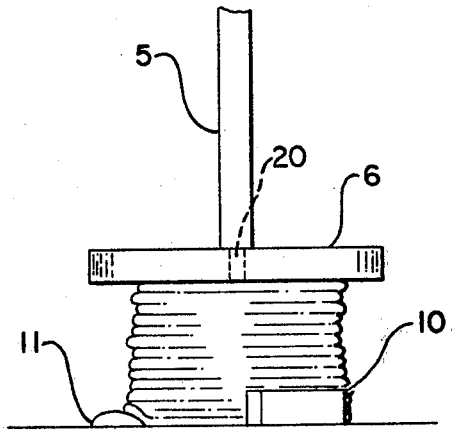
FIG. 4 is a side view of the relevant portion of the apparatus and the crushed can at the end of the crushing operation.

FIG. 2 shows a can placed in position for crushing with one edge of said can placed directly over said bead 11, and the can being held in place by ridges 10. Contact plate 6 first contacts only the edge of the top of said can which is substantially directly over crimping bead 11 thus when a force is applied the pressure is concentrated through a substantially single vertical line along the side of the can directly over the crimping bead 11. With minimal force applied, the can immediately wrinkles along the substantially vertical line directly above the bead. As additional pressure is applied the wrinkles proceed about the circumference of the can in layers as illustrated in FIG. 3. Thus, the instant invention provides a can crushing structure which overcomes the strength inherent in the cylindrical side walls of the can by subjecting the walls to pressure along a single defined line of pressure and incrementing that line of pressure sequentially about the perimeter of the cylindrical wall, as the can begins to collapse. That is, as the layering begins less pressure is required to further compress the layered portions and the folding will extend to the rear of the can without difficulty. Once the layeres portions meet at the rear of the can, another substantially vertical line of pressure is present which collapses as did the first and the entire cylindrical wall of the can layers itself fairly uniformly downwards. The can is easily compressed from that point on into a small volume package as shown in FIG. 4 which can be easily handled and which has no sharp edges. The crushed can is also easily stacked because of the relatively flat top and bottom which are free of distortion.

Figure 5:
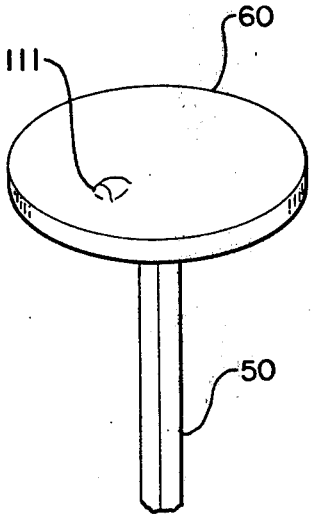
FIG. 5 is a bottom view of the contact plate showing an alternate position of the crimping bead.

The hole placed in the contact plate allows the air trapped inside the can when the contact plate engages the can as shown in FIG. 3. The tops of such cans normally are recessed slightly and thus, provide a route for air to escape. FIG. 5 shows a contact plate having a crimping bead substantially the same as that on the base of the apparatus. A bead so placed eliminates the need for an airhole and allows the trapped air to escape about the sides of the bead.

Thus, it is clear that the crimping bead can be either located on the contact plate, the base or on both so long as the initial pressure is applied along a single substantially vertical line.

The foregoing is considered illustrative only of the principles and specific embodiment of the invention. Further, since numerous modifications and changes will readily occur to those skilled in the art, it is not intended to limit the invention to strictly that described herein but such is to include all modifications and equivalents falling within the scope of the invention herein claimed.

What is claimed is:

1. A can crushing apparatus comprising:

(a) means for holding a can in a substantially upright position;

(b) means for applying compression pressure to said can longitudinally thereof further comprising:

(1) a base having a ridge attached thereto such that the upper portion of said ridge contacts the edge of said can and its longitudinal axis is oblique to the tangent of the perimeter of said can at the point of contact;

(2) an upright member attached to said base;

(3) a mounting member attached to said upright member;

(4) a press member slideably attached to said mounting member having means for allowing air to escape said can; and (5) a handle having a first lever rotatably attached at one end to said mounting member and a second lever attached to said first lever at the end opposite the point of attachment to said mounting member and attached to said press member at a point remote from either end; and (c) a means for crimping at least one side of said can along a substantially vertical first line, thence sequentially about the sides of said can, and terminating along a substantially vertical line second line opposite said first line; whereby a can held by said holding means may be compressed between said base and said press member to produce a circular package of concentrated mass with no cut edges.

2. A can crushing apparatus as described in claim 1 wherein said means for holding a can comprises:

(a) said base;

(b) a plurality of stops arranged oblique to one another attached to said base, and (c) said ridge opposite said stops, whereby a can placed on said base rests against said stops and on said ridge is thereby held in place.

3. A can crushing apparatus comprising:

(a) a flat base;

(b) a support attached to said base;

(c) a hollow tubular member attached to said support with its longitudinal axis perpendicular to said base;

(d) a shaft having upper and lower ends, adapted for insertion into said tubular member and slideable therein;

(e) a handle attached to the upper end of said shaft, (f) a compression plate attached to the lower end of said shaft in a parallel planar disposition relative to said base, (g) a ridge on said base and adapted to have a can positioned thereon so that said ridge contacts at one point the edge of one end of the can, (h) a plurality of stops attached to said base such that a can placed against said stops in a substantially vertical position will be underneath said compression plate, whereby said handle may be activated and said plate compresses said can against said base and said ridge crimps said can at said point thereby crushing the same.

* * * * *